United States Patent [19]

May

[11] Patent Number: 4,516,548

[45] Date of Patent: May 14, 1985

[54] IGNITION DEVICE FOR IMPROVING THE EFFICIENCY OF AND TO REDUCE EMISSIONS OF INTERNAL COMBUSTION ENGINES

[76] Inventor: Michael G. May, CH-1180 Rolle, Bel Air, Switzerland

[21] Appl. No.: 546,250

[22] Filed: Oct. 28, 1983

[51] Int. Cl.[3] ..... F02P 15/00

[52] U.S. Cl. ..... 123/260; 123/263; 123/266; 123/169 EL; 123/169 PA

[58] Field of Search ..... 123/259, 260, 263, 266, 123/267, 169 EL, 169 PA, 169 PH

[56] References Cited

U.S. PATENT DOCUMENTS

| | | | |
|---|---|---|---|
| 1,447,278 | 3/1923 | Brewster | 123/169 EL |
| 2,127,512 | 8/1938 | Harper, Jr. | 123/169 PA |
| 3,776,212 | 12/1973 | Karlowitz | 123/259 |
| 4,061,114 | 12/1977 | Christopher | 123/260 |
| 4,325,332 | 4/1982 | Hukill | 123/169 PA |
| 4,327,681 | 5/1982 | Latsch et al. | 123/260 |
| 4,416,228 | 11/1983 | Benedikt et al. | 123/266 |

FOREIGN PATENT DOCUMENTS

| | | | |
|---|---|---|---|
| 103080 | 3/1961 | Fed. Rep. of Germany | 123/169 PA |
| 31236 | 3/1977 | Japan | 123/169 PA |

*Primary Examiner*—Parshotam S. Lall
*Attorney, Agent, or Firm*—Edwin E. Greigg

[57] ABSTRACT

An ignition device including a hollow central electrode that forms an ignition chamber within the ignition device. The end of the hollow electrode can be shaped to improve the gaseous flow to produce a swirl within the central electrode.

14 Claims, 7 Drawing Figures

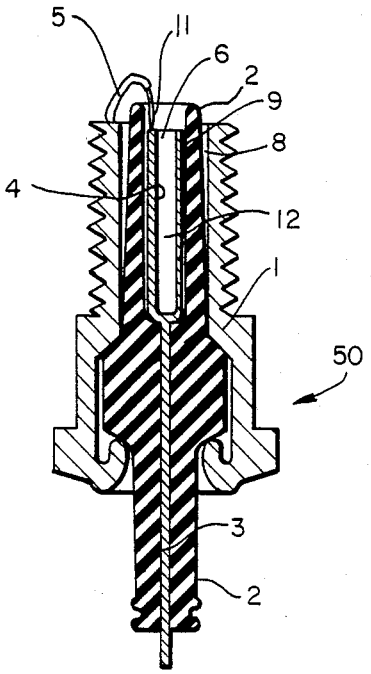
FIG. 1
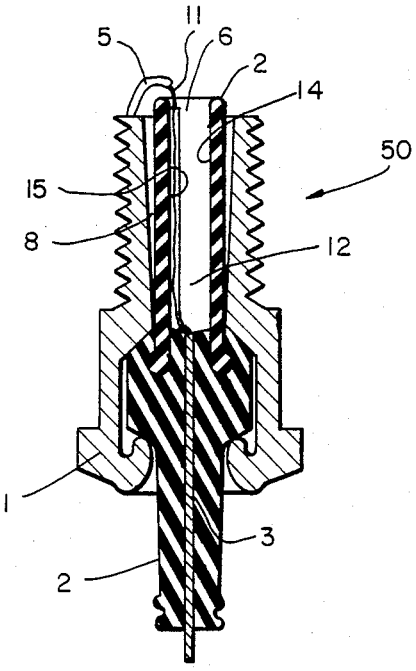
FIG. 2
FIG. 3
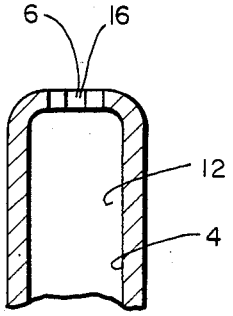
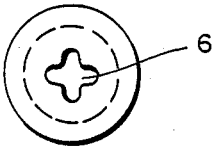
FIG. 4
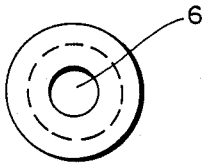
FIG. 5
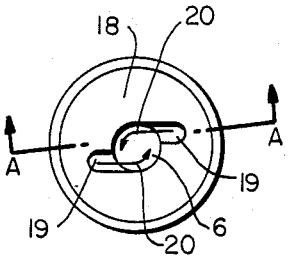
FIG. 6
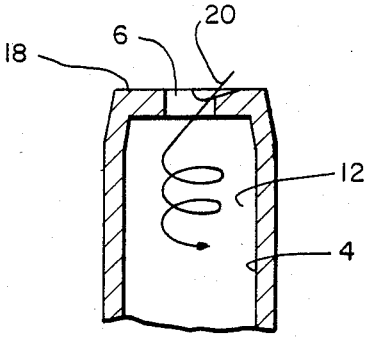
FIG. 7
A-A

IGNITION DEVICE FOR IMPROVING THE EFFICIENCY OF AND TO REDUCE EMISSIONS OF INTERNAL COMBUSTION ENGINES

An ignition device which improves thermodynamic efficiency and reduces gaseous emissions of externally ignited internal combustion engines, especially under low load operation and/or operation with diluted charges.

BACKGROUND OF THE INVENTION

The best theoretic thermodynamic efficiency of internal combustion engines is obtained by a constant volume process as is well known in the prior art.

It is also well known that during low load operation much larger spark advance angles are required than comparatively at full load. Particular large spark advance is required to efficiently utilize the fuel energy in heavily diluted charges in order to avoid an excessively delayed end of heat release. Under diluted charge air/fuel mixtures are understood which contain air excess and/or recirculated exhaust gases. Large spark advance has several known disadvantages, namely severe scatter in the heat release of consecutive combustion cycles and increased emissions.

A large spark advance, which can be up to 50° before top dead center, the combustion even differs widely from the desired constant volume cycle.

As a countermeasure, so called "servo igniting means" have been proposed, whereby a part of the charge, composed at least partially by an air/fuel mixture, is ignited in an ignition chamber, communicating with the main combustion chamber of the combustion engine.

Among a particularly wide variety of such igniting means a relatively recent state of the art is described in DE OS No. 29 16 285 and also in U.S. Pat. No. 4,327,681.

The amount of charge, burning in the ignition chamber should ignite the charge in the main combustion chamber in a faster and more intensive manner, whereby an approach towards a constant volume process can be realized in the main combustion chamber of the engine.

The mentioned devices have a severe draw back in that their improvement advances the art very little and their production costs, for an efficient solution are very high in comparison with the conventional properly adapted spark plug.

Also in the prior art of spark plugs, comprising ignition chamber higher than desired pumping losses, transfer flow losses and wall temperature losses occur. Particularly in the description in German Patent OS No. 29 16 285 a multitude of partial flows, respectively transfer channels, are required to establish a vortex motion of the charge in the ignition chamber. This is particularly expensive and undesirable and furthermore reduces the originally aimed torch effect.

OBJECT AND SUMMARY OF THE INVENTION

An objective of the present invention is to achieve a faster combustion initiation and propagation in a main combustion chamber.

A further object is to reduce the wall temperature losses of such devices.

A further object is to reduce the pumping and transfer port losses.

A further object is to establish a reliable responsible and controllable combustion torch.

A further object is to obtain the above with cheap, easy to produce means which results in a cost/effective device.

A further object is to prepare a spark device which can be utilized even in already produced spark ignited engines.

The invention set forth herein has many advantages related to producibility and effectivity of ignition devices.

By forming a spark plug device with an elongated and compact shape of the ignition chamber, the remaining residual gases of the previous cycle are efficiently pushed back towards the closed end of said ignition chamber by the fresh charge which during the compression stroke flows from the main combustion chamber through the transfer orifice into said ignition chamber so that in the area (zone) adjacent to the transfer orifice where the spark gap is formed, the spark can ignite the existing essentially prevailing fresh charge.

Furthermore a spark plug device is provided with an externally electrically and thermally insulated hollow central electrode which provides after a few working cycles a favorable warming up of the fresh charge in orifice area which produces efficient ignition of even heavily diluted charges and reduces unwanted heat losses. Thereby parts of the fresh charge in the ignition chamber adjacent to said orifice are heated to a temperature from about 800° C. to about 1200° C., whereby the dimensioning of the clearance between the ignition chamber and its surrounding is such that overheating is avoided and that the said fresh charge does not reach self ignition temperature before the spark timing.

The preferably relatively large transfer orifice generates negligible pumping scavenging and filling losses and hence a large amount of the volume of the ignition chamber is utilized for generating an efficient ignition torch.

The intensity, the penetration and the shape of the jet of such an ignition torch are easily determined by the geometry and shaping of the orifice. Known aerodynamic rules apply, as for instance, the jet passing a sharp edged faced orifice gets more internal turbulence and hence has a faster lateral opening pattern, than a jet passing through a rounded and elongated orifice, as is well known.

The radial expansion, especially the turbulence induced in the jet, can be increased also in a known manner by shaping the orifice section into a large circumference to area section, as for instance, starshaped or cross-like sections in cases where a strong torch effect is desired and having only a short penetration.

The invention will be better understood as well as further objects and advantages thereof become more apparent from the ensuing detailed description of preferred embodiments, taken in conjunction with the drawings.

BRIEF DESCRIPTION OF THE DRAWINGS

FIG. 1 is a longitudinal sectional view of a first emodiment of the invention, provided with a hollow metallic central electrode part;

FIG. 2 is a variant of the similar to FIG. 1, wherein the central hollow electrode is essentially an insulator;

FIG. 3 is an enlarged area of a longitudinal section of the orifice area of a further variant;

FIGS. 4, 5 and 6 are top views illustrating the orifices as seen from the main combustion chamber;

FIG. 7 is an enlarged longitudinal cross section through an orifice, as shown in FIG. 6.

DESCRIPTION OF THE PREFERRED EMBODIMENTS

Parts with comparable functions are designated with the same numbers throughout the figures. In FIG. 1 an ignition device 50 comprises a housing 1 which is provided with screw threads on one end thereof for threading the ignition device in the cylinder head of an internal combustion engine, not shown. An insulator 2 including a socket at one end and is fixed in a gas tight manner as it would be in a conventional spark plug. The ignition voltage is conducted via an electrically conductible central electrode 3 towards a ground electrode 5 which is connected in a known manner onto housing 1 and determines together with said central electrode a spark gap 11 in the vicinity of an orifice 6. The central electrode 3 is shaped at its end adjacent to the main combustion chamber, in the form of a hollow body 4 which is received in said socket of said insulator, comprising the orifice 6 through which, during the compression stroke of the corresponding cylinder of said combustion engine, a part of a fresh charge flows into the ignition chamber 12 formed by said hollow body 4. Between the housing 1 and the insulator 2 as well as between said insulator 2 and said central electrode part 4 determining said ignition chamber 12, an annular gap 8 and 9 is formed to provide a required clearance to permit expansion from the different temperature reached during the operation and the different thermal dilatation coefficients of the said components. The gaps are preferably chosen and determined to avoid high temperatures of and in chamber 12 and its orifice zone thereby avoiding self ignition of a part of the charge which during the compression stroke of the engine is forced through the transfer channel or orifice from the engine combustion chamber into the ignition chamber of the ignition electrode before the targeted spark timing. Only the spark shall ignite the charge prevailing at this time in the ignition chamber and once ignited, the charge burns very rapidly, due to its high temperature generating a torch or jet like propagation of hot combustion products which passages through said orifice 6 into the main combustion chamber. Preferably ignition chamber volumes of from about 0.2 $cm^3$ up to about 2.5 $cm^3$ are preferred. By this means, a multitude of nearly simultaneous ignition sources throughout the main combustion chamber are generated.

In FIG. 2, the hollow body 4 which determines said ingition chamber 12 of said central electrode 3 of said ignition device 50 is made of insulating material as for example sintered aluminium oxide or the like. In such a configuration, said front part of the insulator may be made of different insulating material from the opposite insulator part where the central electrode is not hollow, whereby both materials can be sintered together in any known manner. The inside wall 14 along a socket end of said insulator comprises over at least a length sector, an electrically conductive material 15 so that the ignition voltage is conducted from the central electrode 3 towards the ground electrode 5 to form a spark gap 11.

In FIG. 3 a longitudinal section of the orifice area of modified ignition chamber is shown. The sectional area 16 of the orifice 6 is smaller than the sectional areas of the hollow main body determining the ignition chamber. Furthermore the orifice 6 is formed as a cross-like section whereby more lateral turbulence is inducible into the passing medium than with a circular orifice of same area. Preferably the area of an orifice 6 comprises about 10 $mm^2$. FIG. 4 is a top view of said orifice described in FIG. 3. FIG. 5 shows a circular orifice, smaller in diameter than the inner diameter of the ignition chamber.

In the different modifications, the length of the transfer channel is short compared with the cross-sectional diameter of the transfer channel.

FIG. 6 shows an end view of a preferred embodiment and FIG. 7 shows the same orifice in longitudinal section A—A. Here the front surface 18 of the orifice 6 facing towards said main combustion chamberd comprises two guide grooves 19 leading in an approximately substantially tangential manner towards and into said orifice 6 for generating a swirl vortex component in the charge passing during the compression stroke from the main combustion chamber into the ignition chamber of the ignition device. Charge parts flowing in said guide groove 19 and into said orifice 6 follows approximately the path indicated by arrow 20. By this feature an essentially reproducible flow pattern can be established in said ignition chamber 12 during the compression stroke in said ignition chamber to avoid local over temperatures and to ensure a stablished, controllable and reproducible flame propagation in said ignition chamber 12.

The foregoing relates to preferred embodiments of the invention, it being understood that other embodiments and variants thereof are possible within the spirit and scope of the invention, the latter being defined by the appended claims.

What is claimed and desired to be secured by letters patent of the United States is:

1. An ignition device for improving the thermodynamic efficiency of externally ignited spark ignited combustion engines including a main combustion chamber and which has an ignition chamber communicating by means of at least one transfer channel with said main combustion chamber comprising a housing secured at one end to an insulator, a socket in said insulator, a ground electrode on said housing and directed toward a central electrode disposed in said insulator in said housing thereby to form a spark gap therebetween, said central electrode constructed and arranged to have a terminus and to conduct a sparking voltage towards said spark gap, said central electrode further being formed with only part of its length as a hollow body including an orifice and confined by said socket, and said hollow body being insulated from said ground potential and said socket in said insulator such that the spark between the ground electrode and the hollow body is generated within the confinement of the orifice of said hollow body thereby igniting the charge contained therein.

2. An ignition device as claimed in claim 1, whereby said hollow body has only one transfer channel.

3. An ignition device as claimed in claim 2, whereby said transfer channel has a cross section which is smaller than the cross-sectional area of said hollow body.

4. An ignition device as claimed in claim 1, whereby said transfer channel has a cross section which is smaller than the cross-sectional area of said hollow body.

5. An ignition device as claimed in claim 4, whereby the front surface of the orifice of said transfer channel facing said ground electrode comprises at least one guide grooves leading in an approximately substantially tangential manner towards and into said orifice for generating a swirl vortex component in the charge passing during a compression stroke from the main combustion chamber of a cylinder into the ignition chamber of said ignition device in which the charge parts flowing in said guide groove into said orifice thereby follow approximately a path indicated by the arrow in the drawing.

6. An ignition device as claimed in claim 1, whereby the length of said transfer channel is less than the hydraulic diameter of said cross sectional area of said transfer channel.

7. An ignition device as claimed in claim 1, whereby the hollow part of the central electrode is made of an electrically non-conductive material comprising on its inner surface an electrically conductive conductor which extends from said central electrode to the transfer channel of said central electrode.

8. An ignition device as claimed in claim 7, whereby the electrically conductive inner wall surface of said hollow part of said central electrode comprises a thin conductive layer such as a thin oxidation and high temperature proof layer at least along a longitudinal section thereof as for example of noble metal, platinum.

9. An ignition device as claimed in claim 1, whereby the volume of said ignition chamber comprises from about 0.2 $cm^3$ to about 1 $cm^3$.

10. An ignition device as set forth in claim 1, whereby the cross-sectional area of said transfer channel is about 6 $mm^2$ to about 12 $mm^2$.

11. An ignition device as set forth in claim 1, whereby the spark gap is arranged in the zone of said transfer channel.

12. An ignition device as claimed in claim 1, whereby said hollow body is spaced from said insulator by an air gap which substantially surrounds said hollow electrode.

13. An ignition device as claimed in claim 12, whereby said central electrode is spaced from said housing by an air gap.

14. An ignition device as claimed in claim 1, whereby said hollow insulator comprises a front portion and a rear portion said respective portions being sintered to form an integrated unit.

* * * * *